US006463854B1

(12) United States Patent
Rautert et al.

(10) Patent No.: US 6,463,854 B1
(45) Date of Patent: Oct. 15, 2002

(54) DEVICE FOR DETECTING A PRINTING PLATE POSITION

(75) Inventors: Jürgen Rautert; Frank Schumann, both of Heidelberg; Thomas Wolf, Karlsruhe, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/523,109

(22) Filed: Mar. 10, 2000

(30) Foreign Application Priority Data

Mar. 10, 1999 (DE) ..... 199 10 680

(51) Int. Cl.[7] ..... B41F 13/012

(52) U.S. Cl. ..... 101/481; 101/DIG. 36; 101/415.1; 101/477

(58) Field of Search ..... 101/415.1, 477, 101/494, 481, 485, DIG. 36

(56) References Cited

U.S. PATENT DOCUMENTS

| | | | | | |
|---|---|---|---|---|---|
| 4,437,407 | A | * | 3/1984 | Wirz et al. | 101/415.1 |
| 4,596,468 | A | | 6/1986 | Simeth | 356/400 |
| 4,603,641 | A | * | 8/1986 | Jeschke et al. | 101/415.1 |
| 5,305,691 | A | * | 4/1994 | Maeijima | 101/415.1 |
| 5,394,614 | A | * | 3/1995 | Lindner et al. | 101/415.1 |
| 5,497,703 | A | * | 3/1996 | Becker | 101/415.1 |

FOREIGN PATENT DOCUMENTS

| | | | |
|---|---|---|---|
| DE | 30 00 576 A1 | | 7/1981 |
| DE | 31 36 701 C1 | | 4/1983 |
| DE | 35 27 103 C2 | | 10/1986 |
| DE | 19607297 A1 | * | 10/1997 |
| EP | 0 551 976 B1 | | 7/1993 |

* cited by examiner

*Primary Examiner*—Daniel J. Colilla
(74) *Attorney, Agent, or Firm*—Laurence A Greenberg; Werner H. Stemer; Ralph E. Locher

(57) ABSTRACT

A device for detecting the position of a printing plate on a plate cylinder of a printing machine includes path measuring systems corresponding with one edge of the printing plate.

7 Claims, 3 Drawing Sheets

DEVICE FOR DETECTING A PRINTING PLATE POSITION

BACKGROUND OF THE INVENTION

Field of the Invention

The invention relates to a device for detecting a printing plate position on the cylinder of a rotary printing machine.

For checking in-register feeding or positioning of printing plates, it has generally become known to use a closable electric circuit that is closed due to the engagement of register pins of a clamping bar into measuring notches formed in a printing plate.

It has become known, for example, from the published European Patent Document EP 0 551 976 B1 to provide electrically conductive stops for a printing plate, so that a circuit is closed by the electrically conductive printing plate when the latter is fed or comes to bear precisely against the stops, and accurate positioning of the printing plate is indicated in this manner.

SUMMARY OF THE INVENTION

It is an object of the invention to provide a device for detecting a printing plate position that operates without electrically conductive stops.

With the foregoing and other objects in view, there is provided, in accordance with the invention, a device for detecting the position of a printing plate on a plate cylinder of a printing machine, comprising path measuring systems corresponding with one edge of the printing plate.

In accordance with another feature of the invention, the path measuring systems correspond with register punchings formed in the printing plate in a region of register punchings thereof.

In accordance with a further feature of the invention, the path measuring systems, respectively, are formed of a moving or dipping coil or spool and of an armature movable relative to the moving or dipping coil.

In accordance with an added feature of the invention, the path measuring systems, respectively, are disposed at printing-plate stops.

In accordance with an additional feature of the invention, the printing-plate stops are formed as register pins.

In accordance with yet another feature of the invention, the device includes a return spring disposed between the moving coil and the armature.

In accordance with yet a further feature of the invention, an electrical signal is transmittable to a control computer of the printing machine in accordance with the position of the armature relative to the moving coil.

In accordance with a concomitant feature of the invention, the electrical signal is a measure of the position of the printing plate.

Advantageously, path measuring systems based on moving coils are employed as printing-plate detection devices. With the path measuring systems which are used, a high path resolution of about 0.001 mm is realizable.

When a path measuring system is used for each register member, for example, register stop, there being usually two register members for each printing plate, if the printing plate is in a skewed position, the exact extent of the skewed position can be indicated.

The path measuring systems according to the invention are less susceptible to dirt, in comparison with the electrically conductive detection systems heretofore known in the prior art, so that they operate with considerably greater accuracy.

Other features which are considered as characteristic for the invention are set forth in the appended claims.

Although the invention is illustrated and described herein as embodied in a device for detecting a printing plate position, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
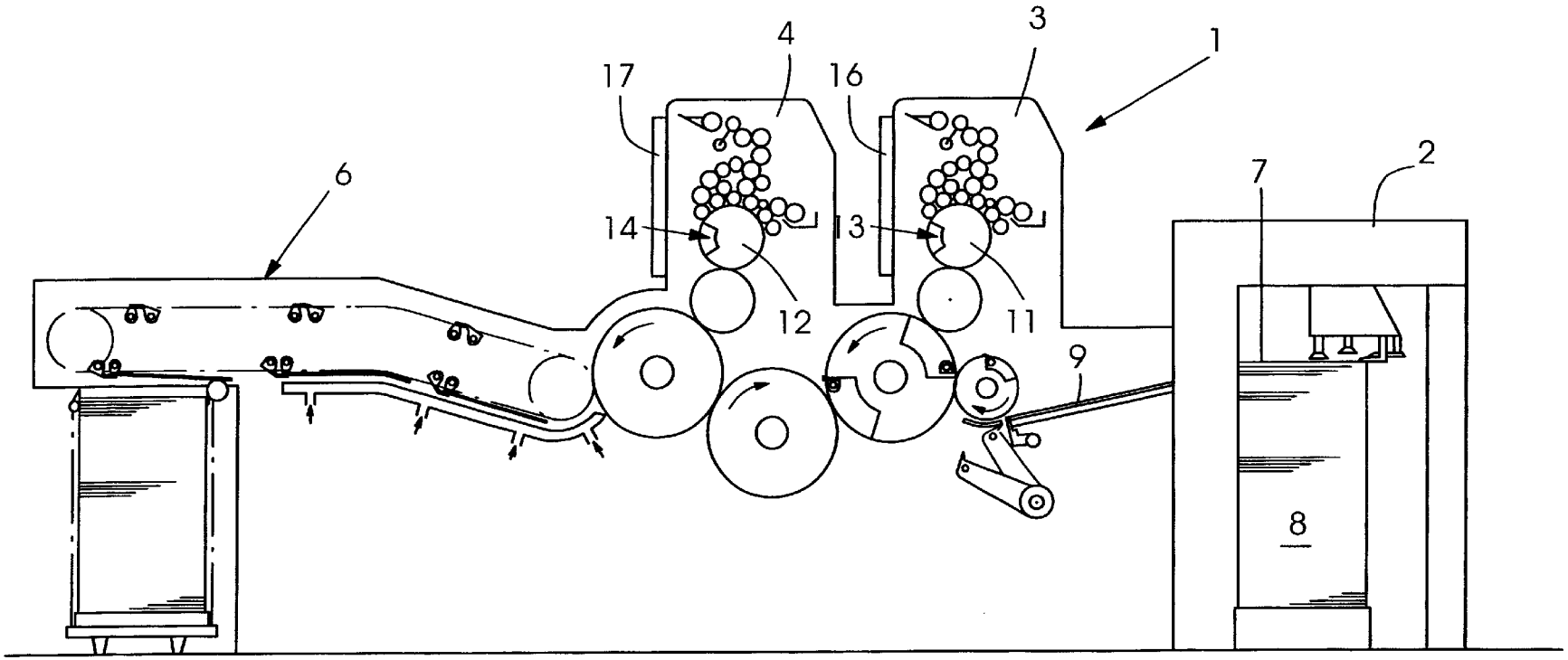
FIG. 1 is a diagrammatic side elevational view of a sheet-fed rotary printing machine incorporating an embodiment of the device according to the invention.

Referring now to the drawings and, first, particularly to FIG. 1 thereof, there is shown therein a rotary printing machine, for example a sheet-processing printing machine 1, having a sheet feeder 2, at least one printing unit 3 and 4 and a delivery 6. Sheets 7 are withdrawn from a sheet pile 8 and fed singly or individually, or in an imbricated manner, via a feeding table 9, to the printing units 3 and 4. The printing units 3 and 4, respectively, contain, in a conventional manner, a plate cylinder 11, 12. The plate cylinders 11 and 12, respectively, have a device 13, 14 for fastening flexible printing plates 16. Furthermore, each plate cylinder 11, 12 has a device 16, 17 assigned thereto for semi-automatically or fully automatically changing a printing plate.

Figure 2:
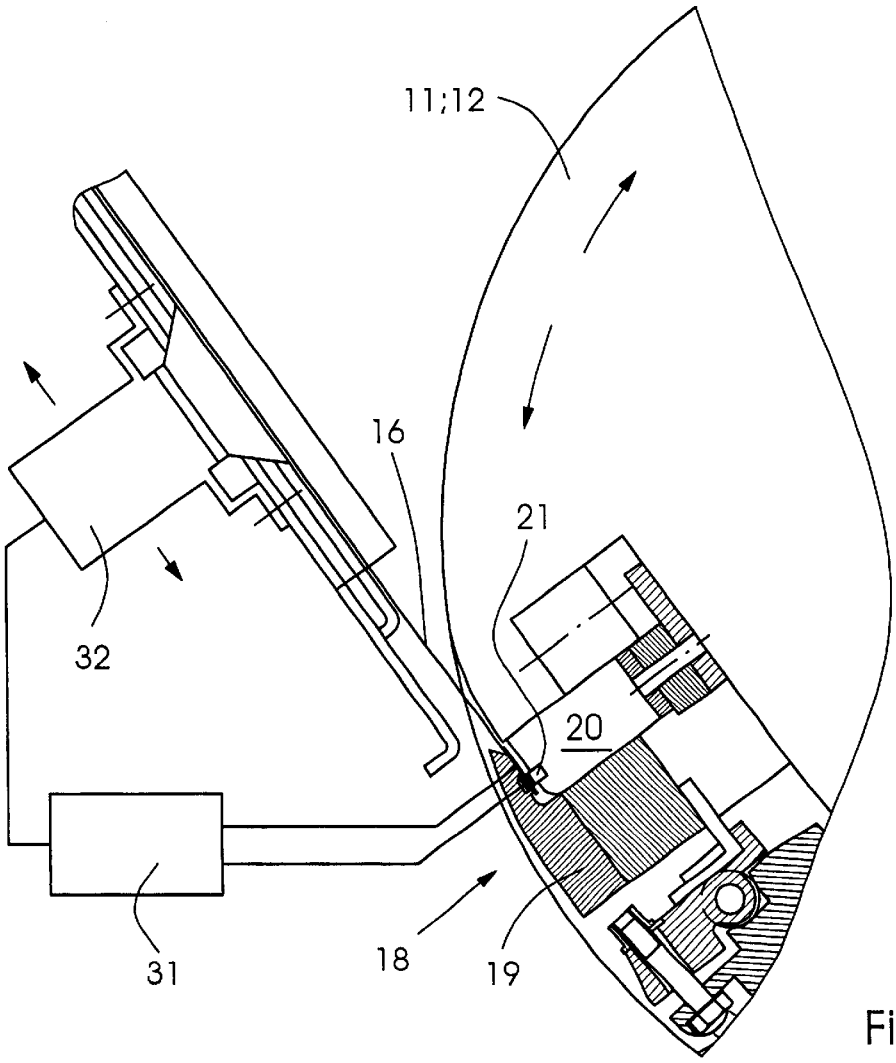
FIG. 2 is an enlarged fragmentary view of FIG. 1 showing a plate cylinder in a position wherein a printing plate is supplied thereto.
Figure 3:
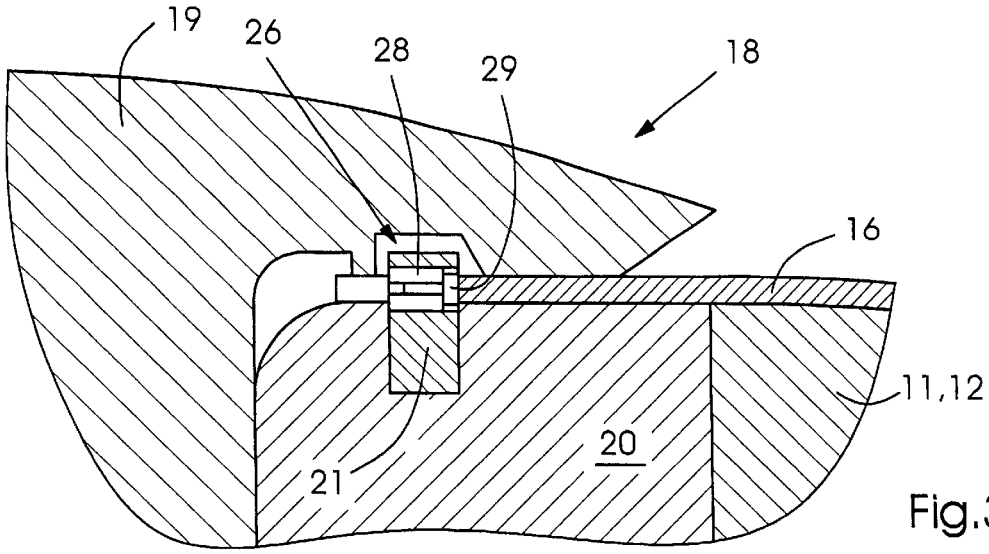
FIG. 3 is an enlarged fragmentary cross-sectional view of FIG. 2, rotated approximately 90° clockwise and showing a region of a clamping bar received on the plate cylinder having a path measuring system arranged in accordance with the invention.
Figure 4:
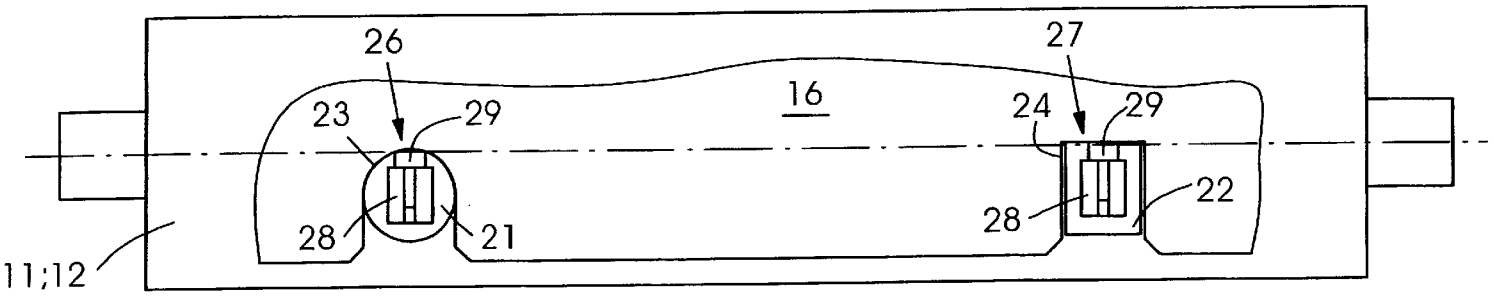
FIG. 4 is a top plan view of a plate cylinder showing an in-register feeding or positioning of a printing plate onto the plate cylinder, with an exemplary embodiment of the arrangement of the path measuring systems according to the invention shown in FIG. 3.
Figure 5:
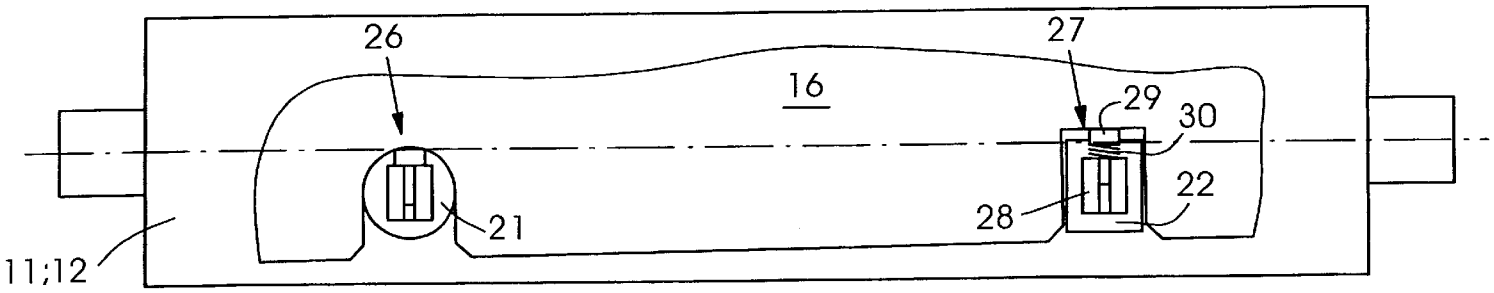
FIGS. 5 and 6 are views like that of FIG. 4 showing the exemplary embodiment with a respective faulty or defective feeding or positioning of the printing plate.
Figure 6:
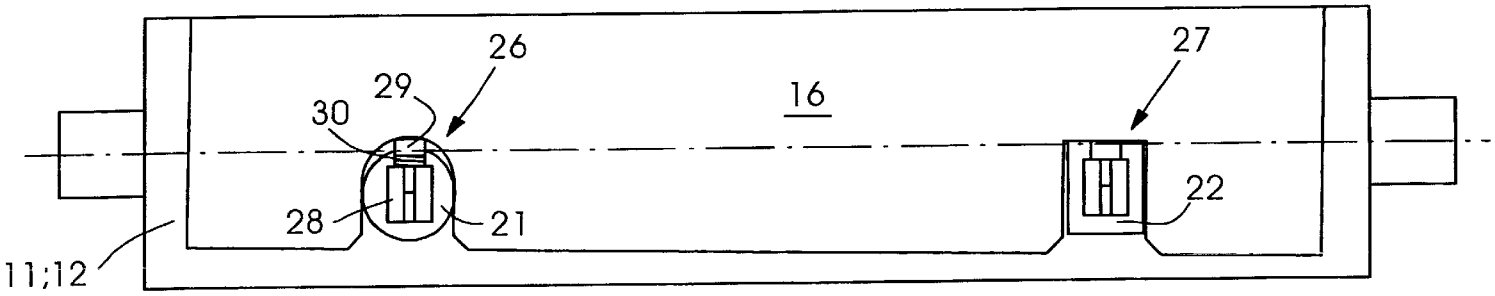

In the exemplary embodiment shown in FIG. 2, this printing-plate fastening device 13, 14, respectively, is formed, inter alia, of a clamping bar 18. The latter has a fixed upper clamping member 19 and a movable lower clamping member 20. According to the exemplary embodiment shown in FIG. 4, in the region for receiving the printing plate 16, that region being formed by the clamping members 19 and 20, stops 21 and 22 are provided, which cooperate with punchings or punched-out recesses 23 and 24 at the leading edge of the printing plate. The stops 21 and 22 may be arranged so as to be axially or circumferentially adjustable relative to the lower clamping member 20.

Each of the stops 21 and 22, respectively, has a path measuring system 26, 27 assigned thereto. Each path measuring system 26, 27 is formed of a moving or dipping coil or spool 28 and an armature 29 constructed as a plunger that is linearly movable in the moving coil 28. A return spring 30 disposed between the armature 29 and the moving coil 28 forces the armature 29 into a predetermined initial position. When the printing plate 16 comes to bear on the register pins 21 and 22, the printing plate 16, with the punched-out recesses 23 and 24 thereof, initially comes into contact with the movable armature 29 of the path measuring systems 26 and 27 and displaces the armature 29 counter to the force of the return spring 30, until the edges defining the punched-out recesses 23 and 24 of the printing plate 16, in the ideal case, bear on the register pins 21 and 22, respectively. The signals, respectively, transmitted to the control computer 31 are compared with one another in a difference-forming method and, in this case, indicate that the path measured between the respective register pin 21, 22 and the printing-plate punching or punched-out recess 23, 24 is equal to zero. The proposed difference-measuring method may be performed by a bridge connection that, advantageously, also simultaneously compensates for temperature fluctuations.

Conclusions may be drawn as to the extent of the skewed position of the printing plate, depending upon the measured distance between the path measuring system 21 and the printing plate punching or punched-out recess 23 and the distance between the path measuring system 22 and the printing plate punching or punched-out recess 24.

These printing-plate skew positions may lie within the tolerance range, so that they do not have to be corrected. Another possibility is to perform the correction of the skew position by activating a printing-plate feeding device 32 or correcting the printing-plate skew position by a non-illustrated conventional diagonal register-adjusting device, which are provided.

When the path measuring system 26 and 27 are used, provision is made for the printing-plate feeding device 32, for example, in the form of a movable sucker 32 or of non-illustrated driven transport rollers, to feed the printing plate 16 to the plate cylinder 11 or 12 or to the clamping device, until a signal confirming the positional accuracy of the printing plate 16 is delivered to the control computer 31. The latter immediately stops the plate feed at a predetermined position, so that in-register clamping can be performed.

The stop position for the printing plate 16, depending upon the position of the printing image on the printing plate 16, may be different from the position predetermined by the register pins 21, so that it is desirable for a skew position of the printing plate 16 relative to the plate cylinder 11, 12 to be at the predetermined extent.

We claim:

1. A device for detecting the position of a printing plate on a plate cylinder of a printing machine, comprising path measuring systems corresponding with one edge of the printing plate, said path measuring systems, respectively, being formed of a moving coil and of an armature movable relative to said moving coil.

2. The device according to claim 1, wherein said path measuring systems correspond with register punchings formed in the printing plate in a region of register punchings thereof.

3. The device according to claim 1, wherein said path measuring systems, respectively, are disposed at printing-plate stops.

4. The device according to claim 3, wherein said printing-plate stops are formed as register pins.

5. The device according to claim 1, including a return spring disposed between said moving coil and said armature.

6. The device as claimed in claim 1, wherein an electrical signal is transmittable to a control computer of printing machine in accordance with the position of said armature relative to said moving coil.

7. The device according to claim 6, wherein said electrical signal is a measure of the position of the printing plate.

* * * * *